United States Patent [19]

Schreier

[11] 4,320,682

[45] Mar. 23, 1982

[54] ENVELOPE GENERATING CIRCUIT FOR AN ELECTRONIC MUSICAL INSTRUMENT

[75] Inventor: Wilford R. Schreier, Bensenville, Ill.

[73] Assignee: Marmon Company, Chicago, Ill.

[21] Appl. No.: 163,629

[22] Filed: Jun. 26, 1980

[51] Int. Cl.[3] ..... G10H 1/02

[52] U.S. Cl. ..... 84/1.26; 84/1.13; 84/1.27

[58] Field of Search ..... 84/1.13, 1.26, 1.27; 307/229, 230; 328/145

[56] References Cited

U.S. PATENT DOCUMENTS 4,109,208 8/1978 Tomisawa et al. ..... 328/14

OTHER PUBLICATIONS

Moorer, "Signal Processing Aspects of Computer Music—A Survey" in Computer Music Journal, vol. 1, No. 1, Feb. 1977, p. 6.

*Primary Examiner*—J. V. Truhe
*Assistant Examiner*—Forester W. Isen
*Attorney, Agent, or Firm*—Neuman, Williams, Anderson & Olson

[57] ABSTRACT

An improved envelope generator circuit for an electronic organ provides a musically correct attack rate, i.e., the volume of a musical note is increased by an equal number of decibels for equal increments of time. The envelope generating circuit comprises a constant current source for charging a capacitor to generate a linearly increasing voltage signal upon the initial activation of any one or more keys of an electronic organ keyboard. A regulator circuit comprising an operational amplifier and a matched pair of transistors with one transistor connected into the feedback path for the operational amplifier generates an anti-logarithmic control signal in response to the linearly increasing voltage signal. The antilogarithmic control signal is used to control the amplification of a controlled amplifier to which music signals from the organ are passed. The amplifier amplifies the musical signals in accordance with the control signal to generate an output which increases in volume an equal number of decibels for equal periods of time.

9 Claims, 1 Drawing Figure

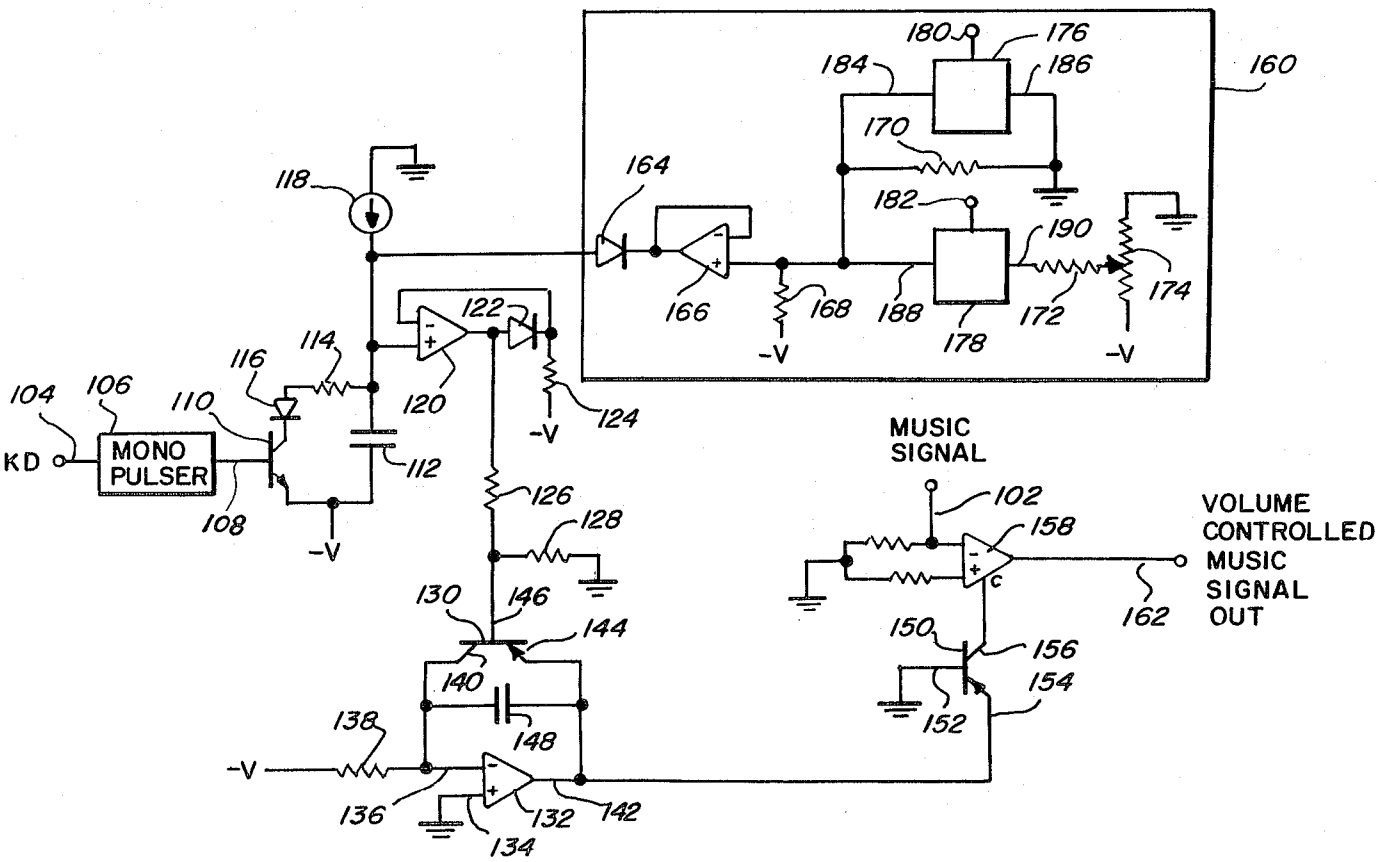
VOLUME CONTROLLED MUSIC SIGNAL OUT
MUSIC SIGNAL
MONO PULSER
KD
-V
160
162
102
104
106
108
110
112
114
116
118
120
122
124
126
128
130
132
134
136
138
140
142
144
146
148
150
152
154
156
158
164
166
168
170
172
174
176
178
180
182
184
186
188
190

ENVELOPE GENERATING CIRCUIT FOR AN ELECTRONIC MUSICAL INSTRUMENT

BACKGROUND OF THE INVENTION

This invention is directed to electronic musical instruments and more particularly to an improved envelope generating circuit for controlling the attack time of musical tones generated by an electronic organ.

In electronic musical instruments, it is advantageous to provide an arrangement for controlling the tone envelope, i.e., the rate of attack and decay of the tone signal to avoid transients which introduce objectionable noise and also to achieve various desirable special effects. For example, in electronic organs a keying signal from a playing key of the organ manual is modulated by a defined envelope signal such that the rate of attack and decay of the keying signal is controlled.

The rate of attack and decay for an applied signal in an electronic organ is typically controlled by the charging and discharging of a capacitor via one or more resistors with the amount of resistance in the charging and discharging paths determining the attack and decay rate of the envelope applied to the music signal. Accordingly, the volume increase and decrease in organs incorporating such envelope generating circuits have an exponentially increasing attack and an exponentially decreasing decay. To be musically correct, the attack or increase in volume of a musical tone as it is played should be in equal numbers of decibels for equal increments of time. Although an exponential increase is a good approximation, it does not achieve the musically correct rate.

SUMMARY OF THE INVENTION

An improved envelope generator circuit provides a musically correct attack rate for musical signals generated by an electronic musical instrument. In accordance with the present invention, the volume of a musical tone is increased by an equal number of decibels for equal increments of time. The improved envelope generator circuit comprises circuitry for generating a linearly increasing signal upon the initial activation of any one or more keys of an electronic instrument keyboard. Regulator means generate an antilogarithmic control signal in response to the linearly increasing signal to control the amplification of a controlled amplifier connected to the regulator means. Music signals are provided to the controlled amplifier which amplifies them in accordance with the control signal to generate output music signals which increase in volume an equal number of decibels for equal periods of time.

In one illustrative embodiment, a current source is used to drive a capacitor for generating a linearly increasing voltage signal. The maximum level of the linearly increasing voltage signal is controlled by a selective voltage level clamping circuit. To initialize the envelope generator circuit, the capacitor is discharged by a monopulser circuit in response to a key down signal. An operational amplifier has a feedback path comprising a first transistor having its emitter terminal connected to the output of the amplifier and its collector terminal connected to an input of the amplifier. The base terminal of the first transistor is driven by the linearly increasing voltage signal. The amplifier drives a second transistor via the emitter terminal of the transistor. The second transistor has its base terminal connected to a reference potential and its collector terminal connected to the control input of a controlled amplifier. The input terminal of the operational amplifier which receives the feedback signal is connected to a source of potential through a resistor. The amplifier maintains the voltage on the emitter of the first transistor at a potential to maintain a constant current flow in the collector of the first transistor and this potential is also applied to the emitter of the second transistor to generate a collector current in the second transistor which is the antilog function of the linearly increasing signal generated on the capacitor.

BRIEF DESCRIPTION OF THE DRAWING

For a more complete understanding of this invention, reference should now be made to the embodiment illustrated in greater detail in the accompanying drawing and described below by way of example of the invention. The drawing is a schematic diagram of an improved envelope generator circuit in accordance with the present invention.

DETAILED DESCRIPTION OF THE ILLUSTRATIVE EMBODIMENT

A schematic diagram of the improved envelope generator circuit in accordance with the present invention is shown in the drawing. Music signals are generated on the conductor 102 by an electronic musical instrument, e.g., an electronic organ, in accordance with techniques which are well known to those skilled in the art of electronic musical instruments. The electronic musical instrument also provides a key down signal on the conductor 104 whenever one or more keys of an instrument keyboard are initially activated by an operator of the musical instrument. The key down signal provided on the conductor 104 is generated only when one or more keys are initially depressed and is not generated if additional keys are depressed while any one or more keys are already depressed. The key down signal on the conductor 104 activates the monopulser 106 to generate a short pulse on its output conductor 108 which drives transistor 110 into its conduction state. Activation of the transistor 110 discharges the capacitor 112 through the resistor 114 and the diode 116. The resistance value of the resistor 114 is set such that the capacitor 112 is substantially discharged during the time duration of the output pulse from the monopulser 106. It should be noted that the present invention can be utilized on a per note basis and accordingly control the attack of each note as its corresponding key is activated.

The constant current source 118 can be any one of a number of well known designs to provide a constant current to charge the capacitor 112 after it has been discharged by the operation of the monopulser 106. The charging of capacitor 112 by a constant current generates a linearly increasing voltage signal on the capacitor 112. The linearly increasing voltage signal is passed to the operational amplifier 120 which serves as a high impedance buffer circuit. The diode 122 and the resistors 124, 126 and 128 provide an input circuit for biasing the transistor 130.

The operational amplifier 132 has its + input 134 connected to ground potential and its − input 136 connected to a negative source of potential −V through the resistor 138. The operational amplifier 132 maintains its input 136 at ground potential which is referred to as a virtual ground. The resistance value of the resistor 138 determines a fixed current which will flow therethrough from the ground potential on the input 136 to the negative source of potential −V. Since the input impedance of the opertional amplifier 132 is very high, the current through the resistor 138 must be provided through the collector terminal 140 of the transistor 130. The operational amplifier 132 maintains the voltage on its output terminal 142 at a potential to maintain the fixed current through the resistor 138. That is, the voltage on the emitter 144 of the transistor 130 is maintained at a value such that the voltage between the base 146 and the emitter 144 will generate the fixed current in the collector 140 to supply the resistor 138. The capacitor 148 connected between the output 142 and the input 136 of the operational amplifier 132 is for noise suppression.

The transistor 150 is matched to the transistor 130 so that they have similar amplification characteristics. The base terminal 152 of the transistor 150 is connected to ground potential. The base 152 to emitter 154 voltage on the transistor 150 due to the action of the operational amplifier 132 produces a collector 156 current flow which increases in proportion to the antilog of the linearly increasing voltage signal generated on the capacitor 112. Accordingly, the amplification of the current controlled amplifier 158 increases in equal decibel increments for equal periods of time. The music input signal on the input conductor 102 is amplified by the current controlled amplifier 158 to increase to a maximum volume at the musically correct rate, i.e., the volume changes an equal number of decibels for equal increments of time.

The envelope generator circuit shown in the drawing also incorporates a volume control circuit 160. The maximum volume of the music signal output on the conductor 162 from the controlled amplifier 158 is controlled by clamping the maximum voltage level of the linearly increasing voltage signal generated on the capacitor 112 via the volume control circuit 160. Two preset and one selective volume level are provided by the control circuit 160 of the illustrative embodiment. Of course it is to be understood that any desired number of preset volume levels can be similarly provided. The diode 164 clamps the maximum voltage level of the capacitor 112 to the output voltage level of the buffer circuit comprising the operational amplifier 166. The high input impedance of the buffer circuit prevents large current flows from altering the voltage levels which are determined by the resistors 168, 170, 172, the variable resistor 174 and the state of the electronic switches 176 and 178.

The electronic switches 176 and 178 are controlled by their control inputs 180 and 182 to provide either a low impedance or a high impedance between their controlled terminals 184, 186 and 188, 190 respectively. The control for the electronic switches 176 and 178 is such that they are either both off, i.e., present a high impedance between their controlled terminals, or one or the other is on, i.e., present a low impedance between their controlled terminals. If both electronic switches 176 and 178 are off, the resistors 168 and 170 form a voltage divider circuit to set the maximum voltage level to which the capacitor 112 can charge. If the electronic switch 176 is on, the maximum voltage level to which the capacitor 112 can charge is set to approximately ground potential to allow the maximum loudness or volume for the musical output signal on the conductor 162. If the electronic switch 178 is on, the resistors 168 and 172 together with the variable resistor 174 define the maximum voltage level to which the capacitor 112 can charge and accordingly, the maximum volume for the output music signals on the conductor 162. The variable resistor 174 can be controlled by an operator of the electronic musical instrument.

In accordance with the above teachings, it will be apparent that an improved envelope generator circuit has been described for use in an electronic musical instrument. The improved generator circuit provides a musically accurate increase in the volume level by equal numbers of decibels for equal increments of time for a more pleasing effect in such electronic musical instruments.

The invention should not be limited to the illustrative embodiment of the improved envelope generator circuit described and taught herein. In view of the above teachings, alternate embodiments and modifications will be apparent to those of ordinary skill in the art. For example, a volume control could be incorporated by varying the resistance valve of the resistor 138 or the potential applied thereto. Such alternate embodiments and modifications are considered to be equivalents of the invention and are intended to be covered by the following claims.

What is claimed is:

1. An envelope generator circuit for use in an electronic musical instrument having means for generating a key down signal and means for generating music signals, said envelope generator circuit comprising:

circuit means for generating a linearly increasing analog voltage signal in response to said key down signal;

regulator means connected to said circuit means for generating a control signal which is the antilogarithm of said linearly increasing analog voltage signal; and, controlled amplifier means receiving said music signals and said control signal from said regulator means for amplifying said music signals by an amplification factor directly proportional to said control signal and for generating volume controlled output music signals which increase equal decibel amounts for equal periods of time.

2. An envelope generator circuit as set forth in claim 1 wherein said regulator means comprises:

an operational amplifier having a first input connected to said reference potential, a second input and an output;

a resistor connected between said second input of said operational amplifier and said power source; and first and second transistors each having base, emitter and collector terminals, said first transistor having its collector terminal connected to said second input of said operational amplifier, its emitter terminal connected to said output of said operational amplifier and its base terminal connected to said circuit means, and said second transistor having its base terminal connected to said reference potential, its emitter terminal connected to said output of said operational amplifier and its collector terminal connected to said controlled amplifier means.

3. An envelope generator as set forth in claim 1 wherein said control signal is a current signal having a magnitude functionally related to said linearly increasing signal by the antilog function and wherein said controlled amplifier means is a current controlled amplifier circuit.

4. An envelope generator circuit as set forth in claim 1 wherein said circuit means comprises:

a capacitor;

a source of constant connected to said capacitor for charging said capacitor; and, means responsive to said key down signal and connected to said capacitor for discharging said capacitor and for initializing said linearly increasing analog voltage signal.

5. An envelope generator circuit for use in an electronic musical instrument having means for generating a key down signal and means for generating music signals, said envelope generator circuit comprising:

circuit means having a capacitor, a source of constant current connected to said capacitor for charging said capacitor and means responsive to said key down signal and connected to said capacitor for discharging said capacitor and for initializing a linearly increasing voltage signal;

regulator means connected to said circuit means for generating a control signal which is the antilogarithm of said linearly increasing voltage signal; and, controlled amplifier means receiving said music signals and said control signal from said regulator means for amplifying said music signals by an amplification factor directly proportional to said control signal and for generating volume controlled output music signals which increase equal decibel amounts for equal periods of time.

6. An enveloped generator circuit for use in an electronic musical instrument having means for generating a key down signal and means for generating music signals, said envelope generator circuit comprising:

circuit means for generating a linearly increasing voltage signal in response to said key down signal:

a voltage clamping circuit connected to said circuit means for setting the maximum magnitude of said linearly increasing voltage signal;

regulator means connected to said circuit means for generating a control signal which is the antilogarithm of said linearly increasing voltage signal; and, controlled amplifier means receiving said music signals and said control signal from said regulator means for amplifying said music signals by an amplification factor directly proportional to said control signal and for generating volume controlled output music signals which increase equal decibel amounts for equal periods of time.

7. The envelope generator circuit of claim 6 wherein said voltage clamping circuit comprises means for generating a plurality of voltage levels and selection means for connecting one of said voltage levels to said circuit means to limit the maximum level of said linearly increasing voltage signal.

8. An envelope generator circuit as set forth in claim 7 wherein one of said voltage levels is variable under the control of an operator of said electronic musical instrument.

9. An envelope generator circuit as set forth in claim 6 wherein said circuit means comprises:

a capacitor;

a source of constant current connected to said capacitor for charging said capacitor;

means responsive to said key down signal and connected to said capacitor for discharging said capacitor and for initializing said linearly increasing voltage signal.

* * * * *